US007647981B2

(12) United States Patent
Grant

(10) Patent No.: US 7,647,981 B2
(45) Date of Patent: Jan. 19, 2010

(54) FIRE SUPPRESSION SYSTEM

(76) Inventor: William Grant, Chicago, IL (US); Sharon Grant, legal representative, 9033 S. Hoyne, Chicago, IL (US) 60620

( * ) Notice: Subject to any disclaimer, the term of this patent is extended or adjusted under 35 U.S.C. 154(b) by 0 days.

(21) Appl. No.: 11/943,761

(22) Filed: Nov. 21, 2007

(65) Prior Publication Data

US 2008/0093092 A1 Apr. 24, 2008

Related U.S. Application Data

(63) Continuation of application No. 11/095,179, filed on Mar. 31, 2005, now Pat. No. 7,363,987.

(51) Int. Cl.
*A62C 35/00* (2006.01)
*B05B 3/00* (2006.01)

(52) U.S. Cl. ..... 169/69; 169/5; 169/20; 239/200; 239/208; 239/209

(58) Field of Classification Search ..... 169/5, 169/16–23, 43, 46; 239/208, 209
See application file for complete search history.

(56) References Cited

U.S. PATENT DOCUMENTS 218,100 A * 7/1879 Whyler ..... 169/16
415,212 A * 11/1889 Maginn ..... 33/17 R
1,421,433 A * 7/1922 Epps ..... 169/13
1,870,692 A * 8/1932 Schooler ..... 169/9
4,047,570 A * 9/1977 Munk ..... 169/16
4,428,434 A 1/1984 Gelaude
5,183,102 A * 2/1993 Clark ..... 165/48.1
5,720,351 A 2/1998 Beukema et al.
5,888,055 A 3/1999 Lee
6,161,623 A 12/2000 Shin
6,336,594 B1 1/2002 Bader et al.
6,415,870 B1 * 7/2002 Matsuoka ..... 169/16
6,422,319 B2 * 7/2002 Haase, III ..... 169/16
6,497,855 B1 12/2002 Wachs
6,536,533 B2 3/2003 Reilly
6,840,457 B2 * 1/2005 Park et al. ..... 239/69
6,907,939 B1 6/2005 Cuyler
6,973,975 B1 12/2005 Adamson et al.
6,981,554 B1 1/2006 Klump
7,201,234 B2 4/2007 Rogers et al.

* cited by examiner

*Primary Examiner*—Len Tran
*Assistant Examiner*—James S Hogan
(74) *Attorney, Agent, or Firm*—Michael P. Mazza

(57) ABSTRACT

In the system or method for sprinklering a building, the building has a water delivery pipe for delivery of water to at least two different floors of the building. On at least two floors, a respective sprinkler pipe with a plurality of sprinklers is installed. Also a respective pump is installed whose outlet is connected to the respective sprinkler pipe, and whose inlet is connected to the water delivery pipe. A respective sensor for the respective pump automatically activates the pump when at least one of the sprinklers is activated.

6 Claims, 1 Drawing Sheet

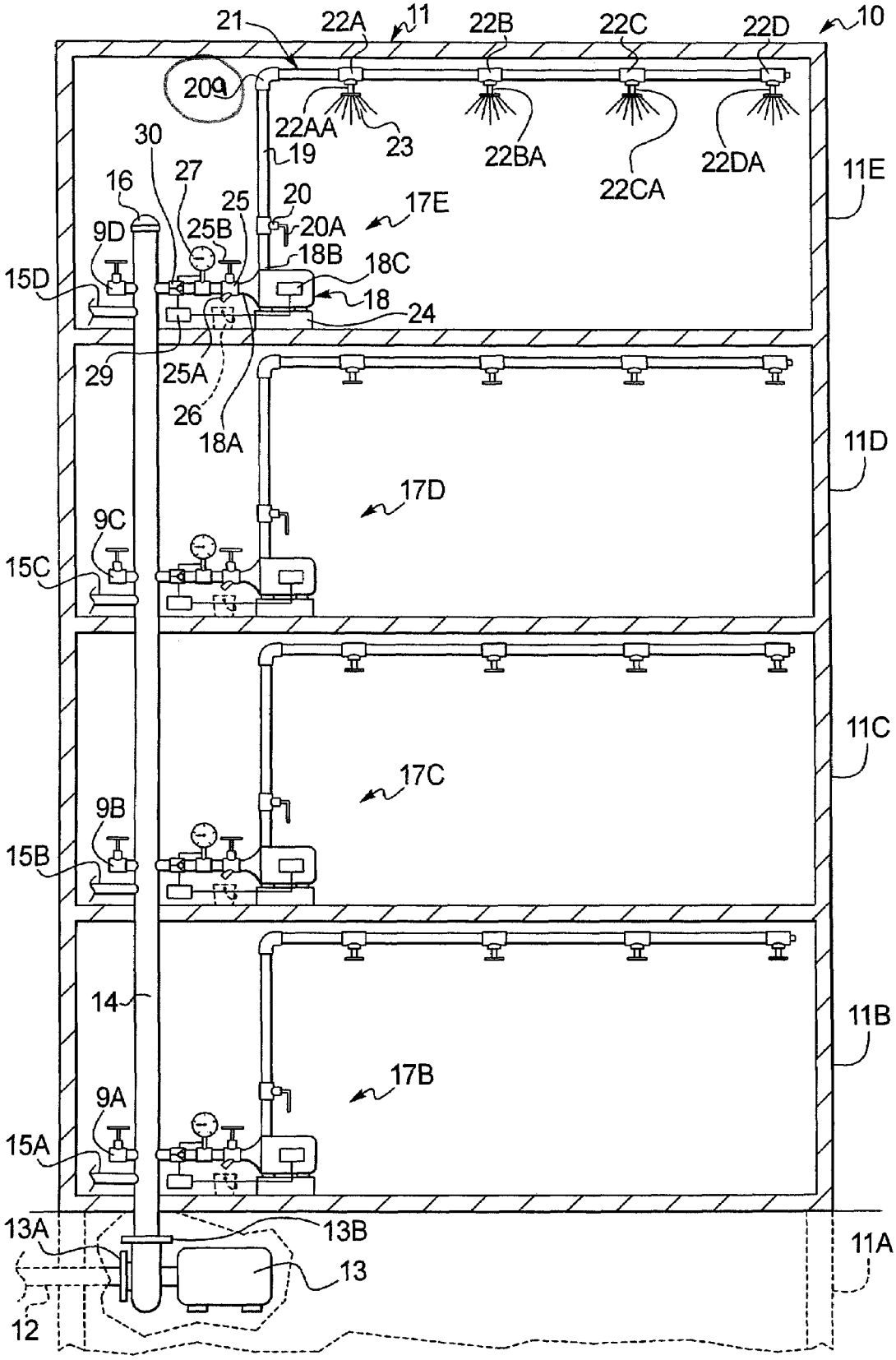
21
22A
11
22B
22C
22D
10
20a
22AA
23
22BA
22CA
22DA
11E
30
19
16
27
25
20
17E
9D
25B
20A
18B
18C
15D
18
24
29
25A
26
18A
11D
17D
9C
15C
11C
17C
9B
15B
14
11B
17B
9A
15A
13A
13B
11A
13
12

FIRE SUPPRESSION SYSTEM

BACKGROUND

During construction of a multi-story building, it is known to install a sprinkler system for fire protection. A specially designed large volume stand pipe specifically for the sprinkler system runs vertically from the basement of the building up to and through the various floors of the building. The bottom of the stand pipe is connected to an output of a building water pump specifically designed for the sprinkler system. An input of the pump is connected to a water supply pipe to the building. On the various floors, the sprinkler system stand pipe connects through a pipe branching out from the stand pipe to the ceiling sprinkler pipe which has a plurality of sprinkler heads installed thereto.

The building water pump must have sufficient pumping capacity to meet the local building code flow rate requirements—for example at least 22 gallons per minute per sprinkler head for a residential building. Depending on the number of sprinkler heads in the building, the pump and the stand pipe must have sufficient capacity to meet the building code pumping requirement per individual sprinkler head.

In very high buildings, it is also known to provide in addition to a single pump such as in the basement, additional booster pumps in series along the stand pipe at various intervals.

In non-sprinklered buildings, it is known to provide a stand pipe extending vertically through the multi-floor building and providing on each floor a so-called "houseline" —that is an individual fire hose outlet connectable or connected to a fire hose. The previously described booster pumps may also be employed in such a stand pipe with line outlets.

It is also known that in non-sprinklered multi-story buildings, particularly older residential buildings, no water flow type fire protection system at all is provided—that is no stand pipes, no house lines, and no sprinkling systems. In these buildings, all that exists is a domestic water supply pipe extending to the various floors of the building to supply domestic water to restrooms, sinks, or water fountains, for example.

It is very expensive to convert a non-sprinklered building to a sprinklered building after the building has been constructed. A large pump must first be installed such as in the basement of the building, along with a high volume high pressure stand pipe extending up through the various floors. This stand pipe must then be connected by branch-off pipes to the ceiling sprinkler pipes being installed on each floor. This is particularly true in non-sprinklered residential buildings where no stand pipe exists but only the low pressure domestic water pipe. Modification of such buildings is very expensive.

SUMMARY

It is an object to reduce the expense of installing a sprinkling system in a multi-story building.

In the system or method for sprinklering a building, the building has a water delivery pipe for delivery of water to at least two different floors of the building. On at least two floors, a respective sprinkler pipe with a plurality of sprinklers is installed. Also, a respective pump is installed whose outlet is connected "to the respective sprinkler pipe, and whose inlet is connected to the water delivery pipe. A respective sensor for the respective pump automatically activates the pump when at least one of the sprinklers is activated.

BRIEF DESCRIPTION OF THE DRAWING

The drawing is a side view of the interior of a building showing a sprinkler system for converting a previously existing non-sprinklered building to a sprinklered building.

DESCRIPTION OF THE PREFERRED EMBODIMENT

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

A sprinkler system for converting non-sprinklered buildings is shown in the drawing at 10. A building 11 has, for example, a basement 11A, and first, second, third and fourth floors 11B-11E. Prior to addition of the building sprinkler system of the preferred embodiment, the existing building 11 was fed by a water supply pipe 12, for example connected at an inlet 13A of a water pump 13 typically located in the basement 11A. The existing building water pump 13 has an outlet 13B connected to a stand or domestic water delivery pipe 14 typically proceeding vertically up through the building to deliver water to the various floors of the building via existing floor supply y pipes 15A-15D. A cap 16 is provided on top of the pre-existing water delivery pipe 14. If the pre-existing water delivery pipe 14 comprises a stand pipe, then in lieu of, or in addition to, the individual floor supply pipes 15A-15D, pre-existing house lines (fire hoses) may be connected to the stand pipe 14 at house line outlets 9A-9D shown in dashed lines.

For converting the non-sprinklered building 11 to-a sprinklered building, the sprinkler system generally shown at 10 is added.

Sprinkler system 10 preferably comprises individual floor sprinkler systems 17B-17E on each floor 11B, 11C, 11D, and 11E. An individual floor system may also be provided in the basement 11A, although not shown.

The individual floor sprinkler systems 17B-17E are preferably respectively provided on each of the floors 11B-11E. Only one of these individual floor sprinkler systems, namely individual floor sprinkler system 17E, will now be described, although the other individual floor sprinkler systems are understood to be substantially the same.

The individual floor sprinkler system 17E comprises a pump 18 having an inlet 18A, outlet 18B, and pressure switch 18C. The outlet 18B connects through a vertical pipe 19 having a shutoff valve 20 with an operating lever 20A inserted in pipe 19. An elbow 20*a* connects the vertical 19 to a ceiling sprinkler pipe 21 having introduced in series individual sprinkler units 22A-22D, each having respective individual sprinkler heads 22AA-22DA, such as bimetallic sprinkler heads, for example.

The pump 18 may be ¼ to ½ horsepower, for example.

The pump inlet 18A is connected to a test water release valve 25 having a control wheel 25B and a spigot 25A. Beneath the spigot 25A, a bucket 26 may be positioned for receiving discharged water during a test described hereafter.

The valve 25 is connected in series with a pressure sensor such as a gauge 27, which in turn is connected to receive water from the water delivery pipe 14 through a one-way valve 30.

The pressure sensor 27 may output either an electrical or pneumatic signal indicative of pressure. This electrical or pneumatic signal may either be directly connected to the pneumatic or electrical pressure switch 18C of the pump 18 or through an intermediary control unit 29 for converting the pneumatic or electrical signal from the pressure sensor 27 into an appropriate signal for the pressure switch 18C. The control unit 29 may also include a control for a setting an activation level for the pressure switch 18C of the pump 18, for example.

Preferably the, pump 18 mounted on a mounting base 24 to raise its elevation sufficiently to allow placement of the bucket 26 underneath the spigot 25A.

Operation of the sprinkler system which converts the non-sprinklered building into a sprinklered building will now be described.

Initially, it is noted that the pump 18 should have a sufficient pumping power so that in the event of a fire, the local fire regulation pumping water flow rate can be achieved from the individual sprinkler units 22A-22D on floor 11E, for example. If for example, the regulation calls for a flow rate of 22 gallons per minute, a regulation typical for a residential building sprinkler heads, the pump. must be sufficiently strong to .provide this flow rate from all of the sprinklers in the floor sprinkler pipe. Although only one sprinkler pipe is shown on floors 11B-11E, of course branching additional sprinkler pipes may be employed to provide additional sprinkler pipes with associated sprinkler units:

During normal operation, shutoff valve 20 is open so that pressure is present at the inlet 18A of the pump 18. If a fire occurs on floor 11E, for example, one or more of the sprinkler heads automatically are activated in well-known fashion (for. example by a bimetallic valve). This causes. a. pressure drop measured by pressure• sensor 27. This pressure drop is transmitted to the pressure switch 18.0 of the pump 18 either directly or through control unit 29, thus automatically triggering operation of the pump 18. When the fire is extinguished and the sprinkler heads dose, pressure again builds in the floor sprinkler system 17E as measured by the pressure sensor 27 resulting in an automatic shut-off of pump 18.

The one-way valve 30 precludes a back flow of water from the individual floor sprinkler system into the vertical water delivery pipe 14.

To test the system, the shut-off valve 20 is closed and the test water release valve 25 is opened by wheel 25B so that water flows out the spigot 25A into the bucket 26. This causes a pressure drop sensed by the sensor 27 such as a gauge, which then activates the pump 18, indicating that the system is operational.

With the disclosed system for converting a non-sprinklered building to a sprinklered building, substantial cost savings result since the existing stand pipe or domestic water pipe is used for delivery of the water to the individual floors. The existing building water pump 13 does not have to be changed. It is thus not necessary to run a new high-pressure pipeline strictly for the building sprinkler system, since the existing stand pipe or domestic water pipe is employed.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

The invention claimed is:

1. A fire suppression system for use in connection with a multilevel building having two or more floors, the building being supplied with water by one or more water delivery pipes in fluid communication with one or more water supply pipes, comprising:

a sprinkler system located in the building and in fluid communication with the one or more water delivery pipes, for distributing water within the building;

two or more pumps located in the building, each of the pumps being in fluid communication with an associated different portion of the sprinkler system and each of the pumps including or associated with a pressure switch and a hydraulic pressure sensor;

whereby a hydraulic pressure drop is measured by the pressure sensors and transmitted to the pressure switches and, upon finding a sufficient pressure drop corresponding to a fire condition, activating the pumps and thereby increasing the water volume which would otherwise be output to the associated different portions of the sprinkler systems; and wherein at least some of the pumps include a shutoff valve and a test water release valve in fluid communication with a one-way valve located on the inlet side of the pump, whereby when the shutoff valve is closed and the test water release valve is opened, a pressure drop sensed by the pressure sensor of the pumps activates the pumps, indicating that at least a portion of the system is operational.

2. The fire suppression system of claim 1, wherein at least one pump is located on each of at least two or more floors of the multilevel building.

3. The fire suppression system of claim 2, wherein two or more of the pumps are located on at least each of two or more floors of the multilevel building.

4. The fire suppression system of claim 1, wherein the pumps each include inlet and outlet sides, and at least some of the pumps also include a one-way valve located on the inlet side, and a shutoff valve located on the outlet side.

5. A fire suppression system for use in connection with a multilevel building having two or more floors, comprising:

a sprinkler system located in the building for conveying a volume of fire-retarding matter;

two or more pumps located in the building, each of the pumps being in fluid communication with an associated different portion of the sprinkler system and each of the pumps including or associated with a pressure switch and a hydraulic pressure sensor;

whereby a hydraulic pressure drop is measured by the pressure sensors and transmitted to the pressure switches and, upon finding a sufficient pressure drop corresponding to a fire condition, triggering operation of the pumps and thereby increasing the volume of fire-retarding matter which would otherwise be output to the associated different portions of the sprinkler systems; and wherein at least some of the pumps include a shutoff valve and a test water release valve in fluid communication with a one-way valve located on the inlet side of the pump, whereby when the shutoff valve is closed and the test water release valve is opened, a pressure drop sensed by the pressure sensor of the pumps activates the pumps, indicating that at least a portion of the system is operational.

6. The fire suppression system of claim 5, wherein the volume of fire-retarding matter comprises water.

* * * * *